US007736023B2

(12) United States Patent
Belliveau et al.

(10) Patent No.: US 7,736,023 B2
(45) Date of Patent: Jun. 15, 2010

(54) SELECTABLE GOBO ANIMATION FOR A MULTIPARAMETER LIGHT

(75) Inventors: Richard S. Belliveau, Austin, TX (US); David K. Peck, Austin, TX (US)

(73) Assignee: BARCO Lightning Systems, Inc., Austin, TX (US)

( * ) Notice: Subject to any disclaimer, the term of this patent is extended or adjusted under 35 U.S.C. 154(b) by 379 days.

(21) Appl. No.: 11/926,632

(22) Filed: Oct. 29, 2007

(65) Prior Publication Data

US 2009/0109680 A1 Apr. 30, 2009

(51) Int. Cl.
*F21V 17/02* (2006.01)

(52) U.S. Cl. ..... 362/284; 362/282; 362/283; 362/319

(58) Field of Classification Search ..... 362/282, 362/285, 287, 323, 319, 207.25, 231, 213, 362/269, 11, 18, 286; 345/158; 359/291; 385/31; 315/293, 294, 312, 314, 315, 317, 315/318, 319, 332, 362, 360
See application file for complete search history.

(56) References Cited

U.S. PATENT DOCUMENTS

| | | | | | |
|---|---|---|---|---|---|
| 4,392,187 | A * | 7/1983 | Bornhorst | ..... | 362/233 |
| 5,402,326 | A * | 3/1995 | Belliveau | ..... | 362/284 |
| 5,406,176 | A * | 4/1995 | Sugden | ..... | 315/292 |
| 5,502,627 | A * | 3/1996 | Hunt et al. | ..... | 362/286 |
| 5,537,303 | A * | 7/1996 | Stacy | ..... | 362/284 |
| 5,691,886 | A * | 11/1997 | Stacy | ..... | 362/283 |
| 6,601,973 | B2 * | 8/2003 | Rasmussen et al. | ..... | 362/282 |
| 7,578,204 | B2 * | 8/2009 | Bornhorst | ..... | 73/862.08 |

OTHER PUBLICATIONS

High End Systems 2001 lighting worldwide—Color Brochure.

* cited by examiner

*Primary Examiner*—Sandra L O'Shea
*Assistant Examiner*—Danielle Allen
(74) *Attorney, Agent, or Firm*—Walter J. Tencza, Jr.

(57) ABSTRACT

A multiparameter lighting apparatus is disclosed that allows an operator of a central controller to remotely choose a first rotation of a selected gobo of the multiparameter lighting apparatus. The first rotation is typically a substantially smooth rotation. A second rotation can also be chosen, wherein the second rotation causes an animation of the selected gobo.

19 Claims, 6 Drawing Sheets

SELECTABLE GOBO ANIMATION FOR A MULTIPARAMETER LIGHT

FIELD OF THE INVENTION

This invention relates to multiparameter lighting fixtures and gobo rotation systems and methods.

BACKGROUND OF THE INVENTION

Multiparameter lighting fixtures are lighting fixtures, which illustratively have two or more individually remotely adjustable parameters such as focus, color, gobo images, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks. Illustrative multi-parameter lighting fixtures are described in the product brochure entitled "The High End Systems Product Line 2001" and are available from High End Systems, Inc. of Austin, Tex.

Multiparameter lighting fixtures are commonly constructed with a lamp housing that may pan and tilt in relation to a base housing so that light projected from the lamp housing can be remotely positioned to project on the stage surface. Commonly a plurality of multiparameter lights are controlled by an operator from a central controller. The central controller is connected to communicate with the plurality of multiparameter lights via a communication system. U.S. Pat. No. 4,392,187 titled "Computer controlled lighting system having automatically variable position, color, intensity and beam divergence" to Bornhorst and incorporated herein by reference disclosed a plurality of multiparameter lights and a central controller. Digital communications between a central controller and a multi-parameter light fixture typically is by wire. In 1986, the United States Institute of Theatre Technology ("USITT") developed a digital communications system protocol for multi-parameter light fixtures known as DMX512.

The lamp housing of the multiparameter light contains the optical components such as a gobo wheel a lens and a lamp. The lamp housing is rotatably mounted to a yoke that provides for a tilting action of the lamp housing in relation to the yoke. The lamp housing is tilted in relation to the yoke by a motor actuator system that provides remote control of the tilting action by the central controller. The yoke is rotatably connected to the base housing that provides for a panning action of the yoke in relation to the base housing. The yoke is panned in relation to the base housing by a motor actuator system that provides remote control of the panning action by the central controller.

Multiparameter lights often use gobos to project patterns upon a stage or other projection surface. A gobo is often comprised of a metal or metal on glass that has been etched into a stencil pattern that provides an image or likeness of the gobo to be projected. The gobo wheel of a prior art multiparameter light is often comprised of a planetary type system and the gobos of the gobo wheel (like the planets) rotate around a sun gear located in the center. Any gobo positioned on the gobo wheel of the multiparameter light may be remotely selected to be brought into position and then projected by the multiparameter light. The gobo wheel often is comprised of two motors. One motor (the gobo select motor) is required to remotely position a selected gobo into the light path for projection and the second motor is required to remotely rotate the selected gobo in a smooth and continuous manner.

The Cyberlight by High End Systems of Austin, Tex. as described in the product brochure entitled "The High End Systems Product Line 2001" incorporates such a gobo wheel to bring selected patterns into the light path for projection and then smoothly rotate the selected gobo in the light path. A further description of a gobo wheel is shown in my U.S. Pat. No. 5,402,326 tilted "Gobo Holder for a Lighting System" to Belliveau et al. In the prior art it has been critical for the rotation of the selected gobo to be substantially smooth as to not cause a distraction during a show to the audience when the multiparameter light is in use. Great care has been taken by multiparameter lighting manufacturers to rotate a selected gobo without any jitter or jerking during the rotations. Motors that often are used to rotate the selected gobo are stepping motors and manufacturers often employ microstepping techniques and circuitry to substantially smoothly rotate the selected gobo.

Through recent experimentation by the inventors it has been found that it can also be desirable to not only rotate the selected gobo in a substantially smooth way but additionally rotate the selected gobo as to cause an animation effect. The animation effect of the selected gobo provides a pleasing new way of rotating the selected gobo of a multiparameter light and thus increases the value of the light during show use to the operator or designer.

SUMMARY OF THE INVENTION

In one embodiment of the present invention, a multiparameter lighting apparatus is disclosed that allows an operator of a central controller to remotely choose a first rotation of a selected gobo of the multiparameter lighting apparatus. The first rotation is typically a substantially smooth rotation. A second rotation can also be chosen, wherein the second rotation causes an animation of the selected gobo.

In at least one embodiment of the present invention the multiparameter lighting apparatus is comprised of a base and a lamp housing. The lamp housing is remotely positionable in relation to the base housing by a motor. The lamp housing is comprised of a lamp, a rotating gobo system, and a projection lens. The lamp typically produces a light path. The multiparameter lighting apparatus may be further comprised of a communications port, a processing system, and a memory, such as a computer or electronic memory.

The rotating gobo system may be comprised of a plurality of rotatable gobos. A first one of the plurality of rotatable gobos can be selected to be in the light path for projection on a projection surface by the projection lens. A first command received by the communications port may cause the first rotatable gobo to rotate in a first state, in which the first rotatable gobo rotates in a substantially smooth manner about a three hundred sixty degree rotation. A second command received by the communications port may cause the first rotatable gobo to rotate in a second state, in which the first rotatable gobo rotates in an incremental manner about a three hundred sixty degree rotation.

A dwell time may be stored in the memory. The dwell time may be a component of each increment when the gobo rotates in the second state. The first command and the second command may be compliant with the DMX protocol.

In one embodiment of the present invention a multiparameter lighting apparatus may be provided which may include a rotatable gobo, a communications port, and a lamp which produces a light path. A first command received by the communications port may cause the rotatable gobo to rotate in a substantially smooth manner about a three hundred sixty degree rotation while in the light path. A second command received by the communications port may cause the rotatable gobo to rotate in an incremental manner about a three hundred sixty degree rotation.

The multiparameter lighting apparatus may include a memory and the increments that the rotatable gobo rotates may be comprised of a rate. The rate may be stored in the memory. The increments that the rotatable gobo rotates may be comprised of a dwell time and the dwell time may be stored in the memory. The incremental manner the gobo is rotated may cause animation effects when a gobo likeness is projected by the multiparameter lighting apparatus.

In one embodiment of the present invention, a method for operating a multiparameter lighting apparatus is provided, wherein the multiparameter lighting apparatus includes a base housing, a yoke, a lamp housing, a projection lens, and a plurality of rotatable gobos, and the lamp housing is remotely positionable in relation to the base housing by a motor. The method may include causing the multiparameter lighting apparatus to produce a light path, and selecting a first rotatable gobo of the plurality of rotatable gobos to be in the light path for projection on a projection surface by the projection lens. The method may further include receiving a first command at a communications port of the multiparameter lighting apparatus and in response to the first command, causing the first rotatable gobo to rotate in a first state. In the first state the first rotatable gobo rotates in a substantially smooth manner about a three hundred sixty degree rotation.

The method may also include receiving a second command at the communications port and in response to the second command causing the first rotatable gobo to rotate in a second state and wherein in the second state the first rotatable gobo rotates in an incremental manner about a three hundred sixty degree rotation.

DETAILED DESCRIPTION OF THE DRAWINGS

Figure 1:
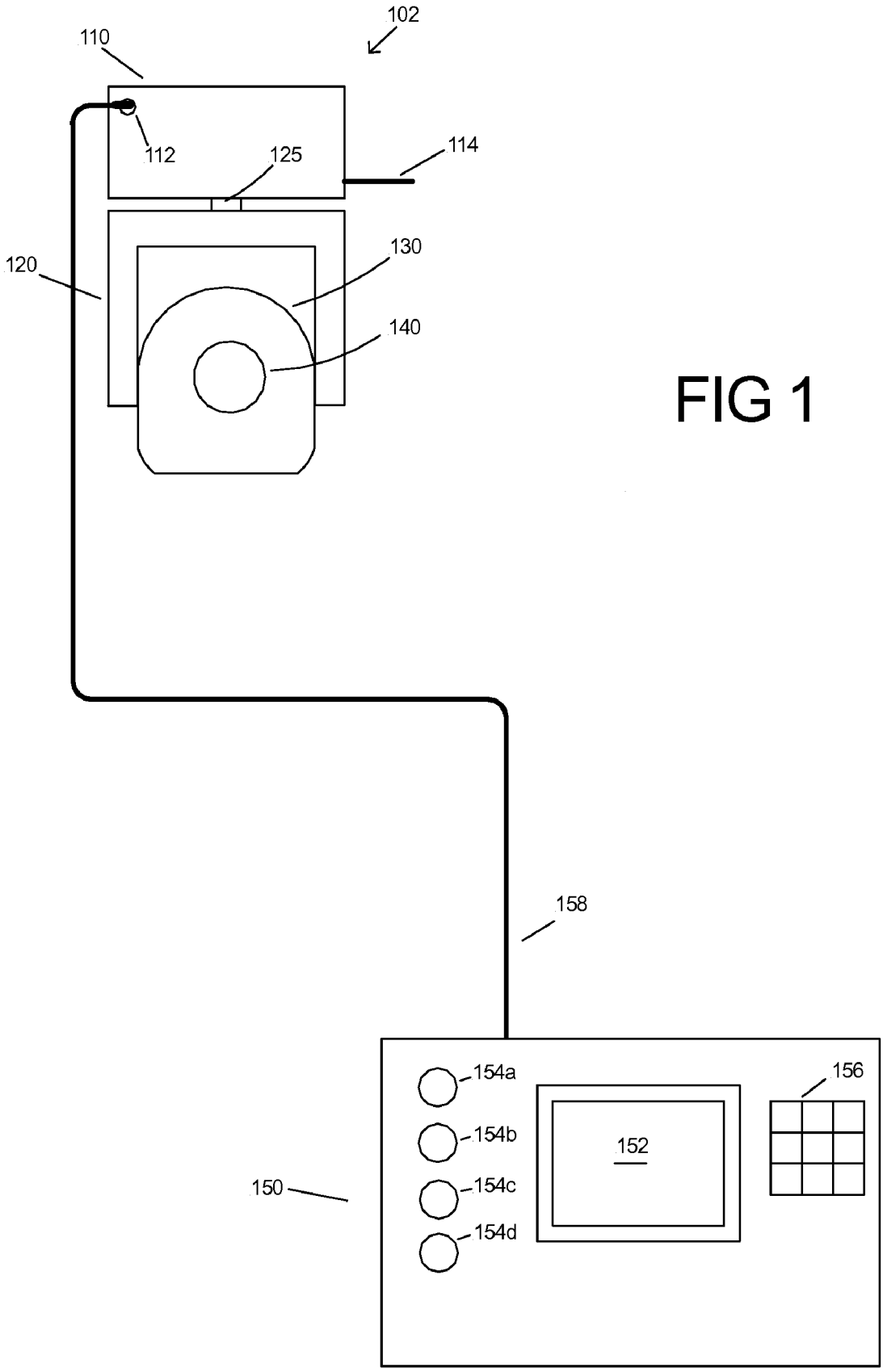
FIG. 1 shows a multiparameter lighting fixture of an embodiment of the present invention incorporating a gobo animation effect.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

FIG. 1 shows a multiparameter lighting fixture 102 in accordance with an embodiment of the present invention. The multiparameter lighting fixture 102 includes a base housing 110, a bearing 125, a yoke 120, and a lamp housing 130.

The base housing 110 is rotatably connected to the yoke 120 by a bearing 125, i.e. the yoke 120 rotates or swivels with respect to the base housing 110. The yoke 120 is driven to rotate in relation to the base housing 110 by a motor actuator (not shown for simplification). The lamp housing 130 is rotatably connected by bearings (not show for simplification) to the yoke 120. The lamp housing 130 is driven to rotate in relation to the yoke 120 by a tilt motor actuator (not shown for simplification).

The lamp housing 130 has an output projection lens 140 used to project images of the selected gobo. The base housing 110 has a communication connector 112 for connecting an external communications cable 158 to a central controller 150 so that an operator may remotely control parameters, including the gobo parameters, of the multiparameter light 102. The communications connector 112 may also provide an output for serial communication to other multiparameter lights (not shown for simplification). A connection lead 114 to a power source (not shown for simplification) is also shown in FIG. 1.

The central controller 150 can be used by an operator to remotely select a gobo to be projected by the output projection lens 140. The operator of the central controller 150 may use a video screen 152 to visualize commands sent from the central controller 150 over the communications line or cable 158 to the multiparameter light 102. A keypad 156 may be used by the operator to select a first or second rotation type for the selected gobo of the multiparameter light 102. One of the control knobs 154*a*, 154*b*, 154*c*, or 154*d* may be used by an operator to select a rotation rate of a selected gobo.

Figure 2:
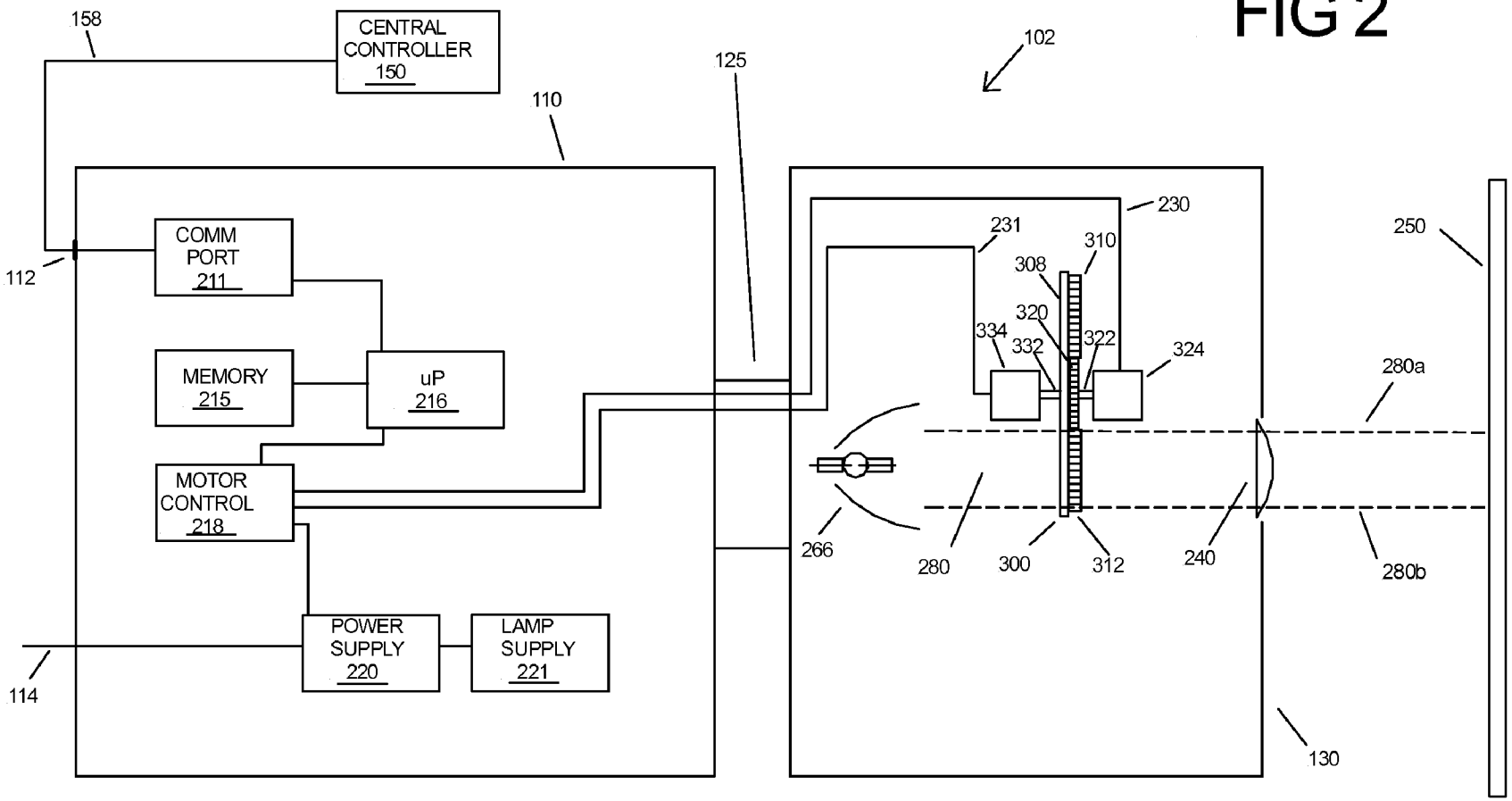
FIG. 2 shows components of the multiparameter lighting fixture of FIG. 1.

FIG. 2 shows components of the multiparameter light 102. The base housing 110 contains a processor or microprocessor 216 that operates with operational software code stored in a memory 215. A communications port 211 is connected to communications connector 112. Communications connector 112 connects communications cable 158 to the central controller 150. A motor control interface 218 can supply control signals to the pan and tilting motors (not shown for simplification) used to position the lamp housing 130 in relation to the base housing 110. Bearing 125 is shown that allows the lamp housing 130 to be positioned in relation to the base housing 110. Other bearings (not shown for simplification) may also be used to position the lamp housing 130 to the base housing 110.

The motor control 218 is shown connected to two motor control lines 230 and 231, which run from the base housing 110 to the lamp housing 130. Motor control line 231 is used to send motor control signals to a motor 334 that turns motor shaft 332 used to position a selected gobo into the light path 280 as represented by dashed lines 280*a* and 280*b*. Motor control line 230 is used to send motor control signals to motor 324 that turns motor shaft 322 that is used to rotate the selected gobo in the light path 280 as represented by dashed lines 28*a* and 280*b*.

Power lead 114 is used to connect a source of power to the multiparameter light 102 (source of power not shown for simplification). The power lead 114 provides power to the power supply 220 that provides power to the electronic components and power to drive the motors such as motors 324 and 334. The power lead 114 also provides power to the lamp supply 221 used to provide power to the lamp 266 (connection not shown for simplification).

Figure 3:
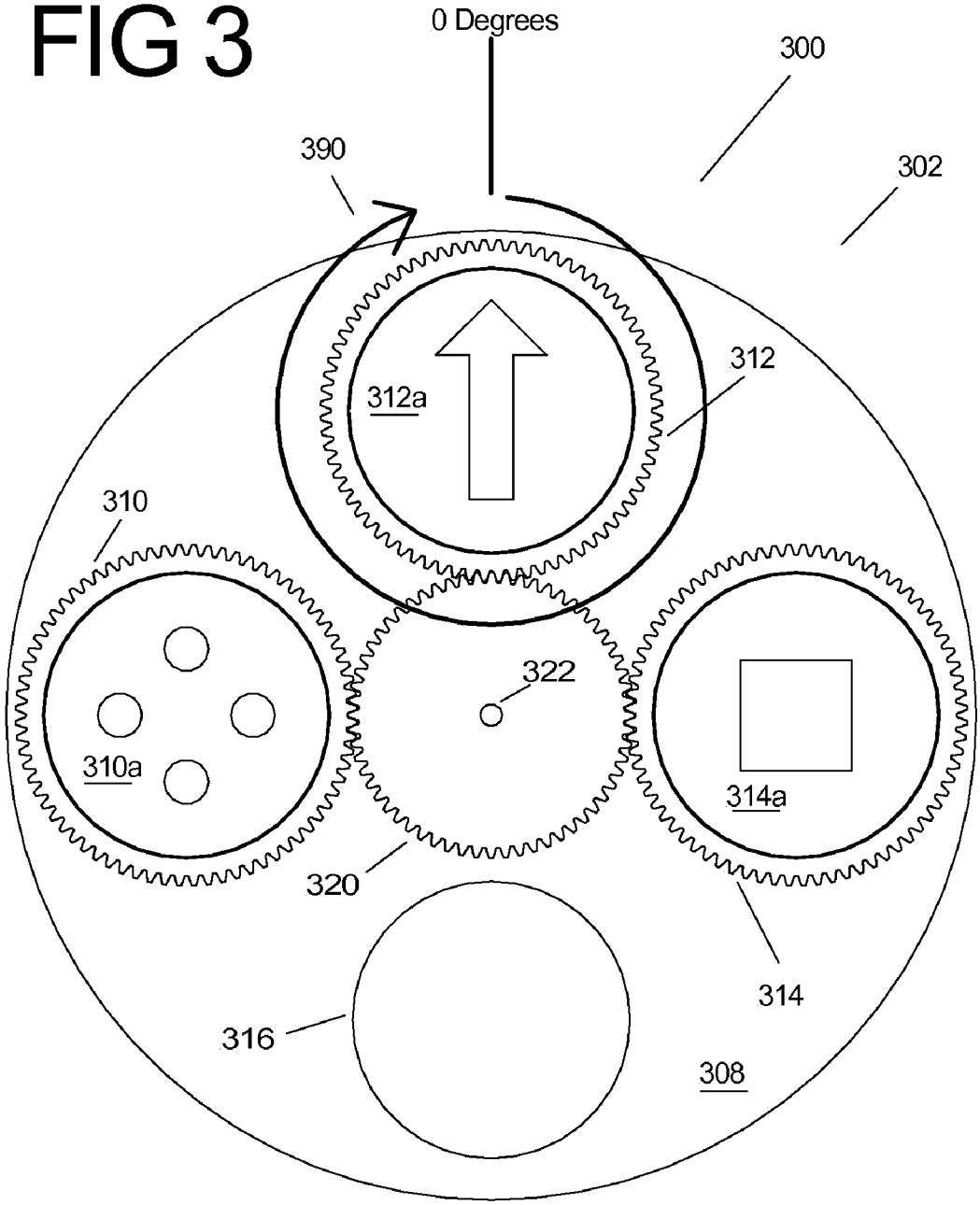
FIG. 3 shows a gobo wheel with a selected gobo that rotates in a substantially smooth way.

A gobo wheel 300 (which is shown in more detail in FIG. 3) is positioned in the light path 280 so that one of a plurality of gobos 310*a*, 312*a*, or 314*a* of FIG. 3 may be selected to be brought into position into the light path 280 of FIG. 2 by motor 334. In FIG. 2 the gobo rotation gear 312 for arrow gobo 312*a* is shown in the light path 280. Also shown in FIG. 2 is gobo rotation gear 310, gobo sun gear 322 and the gobo wheel plate 308.

FIG. 3 shows the gobo wheel 300 of an embodiment of the present invention in a first state 302 operating the rotation of the gobo rotation gear 312 and the corresponding arrow gobo 312*a* using a first substantially smooth rotation. The gobo wheel 300 operates in a first state 302 after receiving a first command at the communications port 211. A smooth rotation preferably has little jitter or jerking during the rotation of the gobo wheel 300 so as not to cause a distraction of the audience during a show. A sun gear 320 is positioned between gobo rotation gears 310, 312 and 314 with their corresponding gobos 310*a*, 312*a* and 314*a*, respectively. The sun gear 320 shows a section of the motor shaft 322 of motor 324 of FIG. 2. The motor shaft 322 may be fixed to the sun gear 320 in any suitable manner. A non patterned fixed aperture 316 is shown cut out of a gobo mounting plate 308. A zero degree mark is shown at the top of gobo wheel 300 in FIG. 3 for illustratively indicating a start position for the rotation of arrow gobo 312*a* by gobo rotation gear 312. An arrow 390 indicates that the gobo 312*a* can be smoothly and continuously rotated by the gobo rotation gear 312 as driven by the sun gear 320 by motor shaft 322 in a substantially smooth clockwise direction. Changing the rotation direction of the gobo 312*a* to counter clockwise in a substantially smooth rotation is also possible but not shown for simplification. The motor 324 of FIG. 2 drives the gobo gear 312 by way of the sun gear 322 in a substantially smooth rotation throughout a 360 degree rotation. The motor control 218 of FIG. 2 provides motor control signals in a first state to the motor 324 that results in a substantially smooth rotation of the motor 324 by way of motor control line 230. The first state motor control signals are generated by the first state operational control software stored in the memory 215 of FIG. 2. The motor control 218 provides the substantially smooth rotation signal to the motor 324 by operating in accordance with the operating software stored in the memory 215. The operating software stored in the memory 215 has been created so that the motor 324 drives the sun gear 320 in a substantially smooth rotation and thus drives the gobo rotation gear 312 also in a substantially smooth rotation. It is important for the gobo 312*a* to rotate in a substantially smooth manner in order not to distract the show audience. Any jitter of jerking of the gobo 312*a* during rotation in the light path 280 of FIG. 2 while being projected by the lens 240 on the projection surface 250 that is visible to the audience is not desirable. The gobo 312*a* may be driven in sequential three hundred and sixty degree rotations by the motor 324 of FIG. 2 in either a clockwise or counter clockwise manner.

Figure 4:
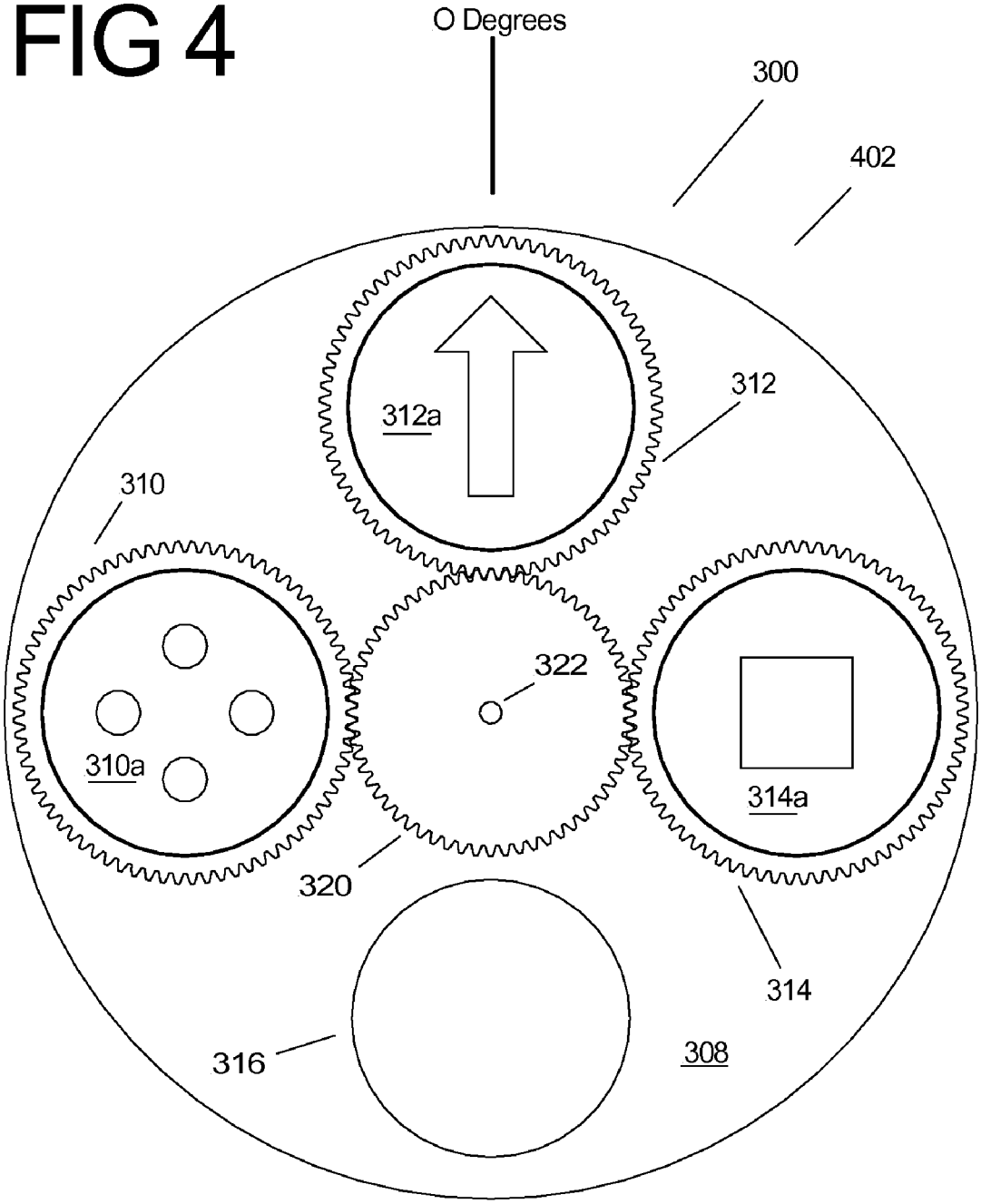
FIG. 4 shows the gobo wheel of FIG. 3 with the selected gobo in a first angular position of an animation sequence.
Figure 5:
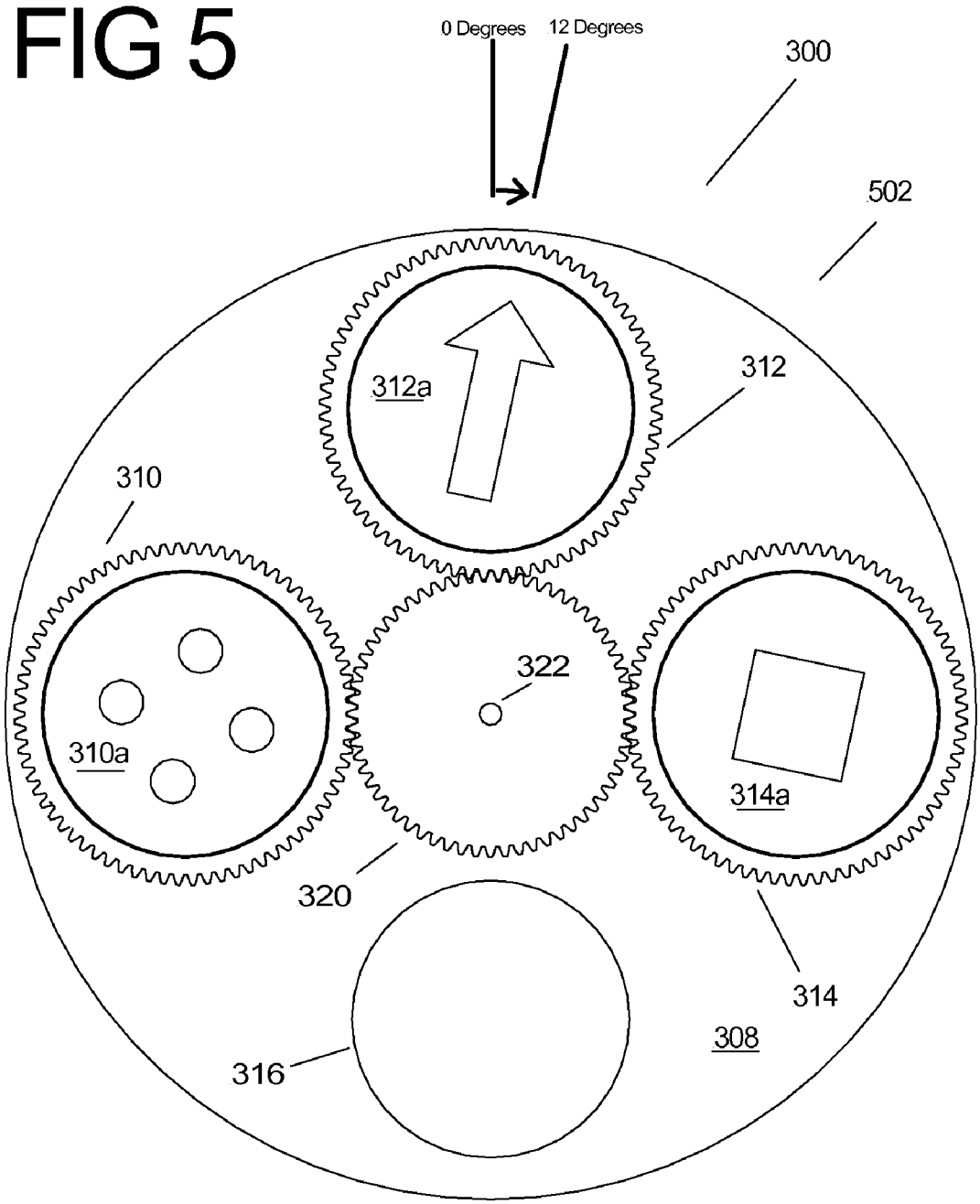
FIG. 5 shows the gobo wheel of FIG. 4 in a second angular position of the animation sequence.
Figure 6:
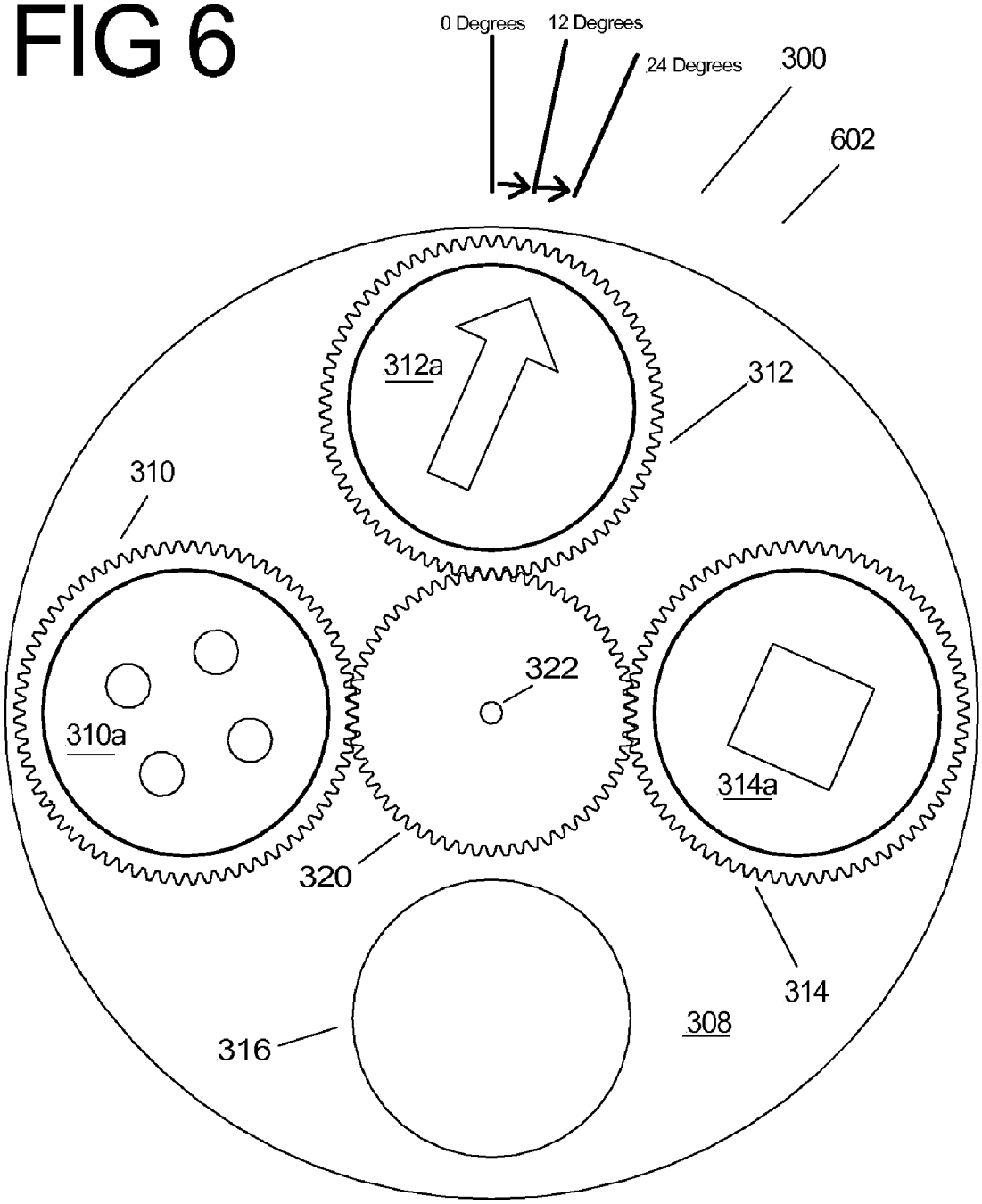
FIG. 6 shows the gobo wheel of FIG. 5 in a third angular position of the animation sequence.

FIG. 4 shows the gobo wheel 300 of an embodiment of the present invention in a first step 402 of a second state. The gobo wheel 300 operates in a second state 402 after receiving a second command at the communications port 211. The second state causes the arrow gobo 312*a* to rotate in an incremental manner thus causing an animation effect. The first step 402 of the second state shows the arrow gobo 312*a* of gobo rotation gear 312 pointed at the 0 degree reference. A sun gear 320 is positioned between gobo rotation gears 310, 312 and 314 with their corresponding gobos 310*a*, 312*a* and 314*a*. The sun gear 320 shows a section of the motor shaft 322. The non patterned fixed aperture 316 is shown cut out of the gobo mounting plate 308. A zero degree mark is shown for illustratively indicating a start position for the rotation of arrow gobo 312*a* by gobo rotation gear 312. The motor 324 of FIG. 2 drives the gobo gear 312 by way of the sun gear 322 in an incremental manner. The motor 324 receives second state motor control signals from the motor control 218. The second state motor control signals are generated by the second state operational control software stored in the memory 215 of FIG. 2. The first state operational control software and the second state operational control software stored in the memory 215 of FIG. 2 are different. It is preferred that the increment be twelve degrees as shown by FIGS. 5 and 6 but other incremental values can be used. The motor control 218 of FIG. 2 provides motor control signals in a second state to the motor 324 that results in an incremental movement of the motor 324 by way of motor control line 230. The motor control 218 provides the incremental movement of the motor by operating in accordance with the operating software stored in the memory 215. The motor control 218 of FIG. 2 can rotate the gobo arrow 312*a* by way of the sun gear 322 in an increment of twelve degrees as shown by new gobo arrow position 512*a* of FIG. 5. The gobo 312*a* may be driven to continuously increment the gobo 312 by the motor 324 of FIG. 2 in either a clockwise or counter clockwise manner.

FIG. 5 shows the gobo wheel 300 of the invention in a second step 502 of the second state. FIG. 5 shows that the gobo 312*a* has been incremented clockwise by twelve degrees to form gobo 312*a*. The sun gear 320 is positioned between gobo rotation gears 310, 312 and 314 with their corresponding gobos 310*a*, 312*a*, and 314*a*. The sun gear 320 shows a section of the motor shaft 322. The non patterned fixed aperture 316 is shown cut out of the gobo mounting plate 308. A zero degree mark and a twelve degree mark are shown for FIG. 5 for illustratively indicating that the gobo 312*a* has been rotated in an increment of twelve degrees from that of the 0 degree position shown by FIG. 4. The motor 324 of FIG. 2 drives the gobo gear 312 by way of the sun gear 322 in an incremental manner.

FIG. 6 shows the gobo wheel 300 of an embodiment of the present invention in a third step 602 of the second state. FIG. 6 shows that the gobo 312*a* has been incremented clockwise by twelve degrees from its position in FIG. 5. The sun gear 320 is positioned in FIG. 5 between gobo rotation gears 310, 312 and 314 with their corresponding gobos 310*a*, 312*a* and 314*a*. The sun gear 320 shows a section of the motor shaft 322. A non patterned fixed aperture 316 is shown cut out of the gobo mounting plate 308. A zero degree mark, a twelve degree and a twenty-four degree mark are shown for FIG. 6 for illustratively indicating that the gobo 312*a* has been rotated in an increment of twelve degrees from that of the twelve degree position shown by FIG. 4. The motor 324 of FIG. 2 drives the gobo gear 312 by way of the sun gear 322 in an incremental manner. Although only two twelve degree increments are shown by way of FIGS. 4, 5 and 6 the incremental rotation of the gobo in the second state can continue throughout a full three hundred and sixty degree rotation.

The gobo position marked at zero degrees for FIG. 4, twelve degrees for FIG. 5 and twenty-four degrees for FIG. 5 can have an associated dwell time. It has been found that the dwell time for each increment works best with a dwell time of between ten milliseconds to one second but other dwell times may be used between each increment. The rate of gobo movement from one angular position to another as the gobo increments is preferred to be between twenty-five milliseconds and three hundred milliseconds A plurality of rate times are stored in the memory 215 of FIG. 2 and can be called up by a command from the central controller 150 by an operator. The dwell time between increments and the rate of the increment can be remotely controlled by an operator of the central controller 150 of FIG. 1. Alternatively the second command alone may cause the selected gobo, such as one of gobos 310*a*, 312*a*, and 314*a*, to rotate with a predetermined dwell time and a rate of increment. The operating software stored in the memory 215 predetermines the degree of increment that the gobo advances by when the second command is received by the communications port 211. The operating software stored in the memory 215 predetermines the dwell time that the gobo dwells between increments when the second commend is received by the communications port 211. The dwell time for each increment causes the gobo rotation to look as it is rotating frame by frame. Incremental rotation of the gobo in a frame by frame manner slower than twenty-four increments per second causes the incremental gobo rotation to have a desirable primitive film look that is referred to as an animation. The operator of the central controller 150 of FIG. 1 may send dwell times, rate of increment and increment size in degrees commands to the multiparameter light 102 of FIG. 1 via the communications line 158. The operator may vary a control knob of the central controller 150 to vary the parameters of dwell time, rate of increment and increment size in degrees by varying any of the control knobs shown as 154*a*, 154*b*, 154*c* and 154*d*. The commands to vary the gobo rotation operation of the multiparameter light 102 to a first state and to a second state sent by the central controller 150 and received by the multiparameter light 102 of an embodiment of the present invention over the communications cable 158 may be in accordance with the DMX 512 protocol.

The operator of the central controller 150 can send commands to the multiparameter light 102 that remotely vary which one of the gobos, such as one of gobos 310*a*, 312*a*, and 314*a*, on the gobo wheel 300 are placed into the light path 280 of FIG. 2 of multiparameter light 102. Once the operator has selected a gobo to be brought into the light path 280 the operator of the central controller 150 may choose one of two or more states to rotate the selected gobo. The operator of the central controller 150 may send a first command to rotate the selected gobo in a first state. The first command is received by the communications port 211 of FIG. 2 and the first command is interpreted by the processor 216 in accordance with the operational software stored in the memory 215. The processor 216 communicates with the motor control system 218 to send motor drive signals to the gobo rotation motor 324 via motor control line 230. The motor 324 then rotates the selected gobo in a substantially smooth manner. The operator of the central controller 150 may send a second command to rotate the selected gobo in a second state. The second command is received by the communications port 211 of FIG. 2 and the second command is interpreted by the processor 216 in accordance with the operational software stored in the memory 215. The processor 216 communicates with the motor control system 218 to send motor drive signals to the gobo rotation motor 324 via motor control line 230. The motor 324 then rotates the selected gobo in an incremental manner. The ability to rotate the selected gobo in a first state of substantially smooth gobo rotation and the second state of incremental gobo rotation is a component of the operational software stored in the memory 215.

We claim:

1. A multiparameter lighting apparatus comprising
a base;
a lamp housing;
wherein the lamp housing is remotely positionable in relation to the base housing by a motor,
the lamp housing comprising
a lamp,
a rotating gobo system, and a
a projection lens,
wherein the lamp produces a light having a light path;
and further comprising a communications port,
a processing system, and
a memory;
the rotating gobo system comprising
a plurality of rotatable gobos, including a first rotatable gobo;
wherein the first rotatable gobo can be selected to be in the light path by the rotating gobo system, wherein the light is projected through the first rotatable gobo and through the projection lens onto a projection surface;
wherein a first command received by the communications port causes the first rotatable gobo to rotate in a first state such that the first rotatable gobo rotates in a substantially smooth manner about a three hundred sixty degree rotation, such that in response to the first command, the first rotatable gobo rotates continuously from a first rotational position through a second rotational position to a third rotational position,
wherein a second command received by the communications port causes the first rotatable gobo to rotate in a second state such that the first rotatable gobo rotates in an incremental manner about a three hundred sixty degree rotation, such that in response to the second command, the first rotatable gobo:
rotates from the first rotational position to the second rotational position continuously;
stops rotating for a dwell time after reaching the second rotational position;
rotates from the second rotational position to the third rotational position continuously;
and stops rotating for the dwell time after reaching the third rotational position;
wherein the difference between the first rotational position and the second rotational position is an increment, and the difference between the second rotational position and the third rotational position is the increment;
and wherein the second command includes the dwell time and the increment.

2. The multiparameter lighting apparatus of claim 1
wherein the dwell time is stored in the memory;
wherein the dwell time is a component of each increment when the gobo rotates in the second state.

3. The multiparameter light apparatus of claim 1 wherein
the first command and the second command are compliant with the DMX protocol.

4. A multiparameter lighting apparatus comprising
a rotatable gobo;
a communications port; and
a lamp which produces a light having a light path;
wherein a first command received by the communications port causes the rotatable gobo to rotate in a substantially smooth manner about a three hundred sixty degree rotation while in the light path, such that in response to the first command, the rotatable gobo rotates continuously from a first rotational position through a second rotational position to a third rotational position; and
wherein a second command received by the communications port causes the rotatable gobo to rotate in an incremental manner about a three hundred sixty degree rotation, such that in response to the second command, the rotatable gobo:

rotates from the first rotational position to the second rotational position continuously;

stops rotating for a dwell time after reaching the second rotational position;

rotates from the second rotational position to the third rotational position continuously;

and stops rotating for the dwell time after reaching the third rotational position;

wherein the difference between the first rotational position and the second rotational position is an increment, and the difference between the second rotational position and the third rotational position is the increment;

and wherein the second command includes the dwell time and the increment.

5. The multiparameter lighting apparatus of claim 4 further comprising a memory; and wherein the second command includes a rate at which the rotatable gobo rotates from the first rotational position to the second rotational position continuously.

6. The multiparameter lighting apparatus of claim 4 further comprising a memory;

wherein the dwell time is stored in the memory.

7. The multiparameter lighting apparatus of claim 3 wherein the incremental manner the gobo is rotated causes animation effects when a gobo likeness is projected by the multiparameter lighting apparatus.

8. The multiparameter lighting apparatus of claim 3 wherein the first and second commands received by the communications port are compliant with the DMX protocol.

9. A multiparameter lighting apparatus comprising a rotatable gobo;

a memory;

a communications port; and a lamp which produces a light having a light path;

wherein a first command received by the communications port causes the rotatable gobo to rotate in a first state and a first state operational code is stored in the memory, such that in response to the first command, the rotatable gobo rotates continuously from a first rotational position through a second rotational position to a third rotational position;

wherein a second command received by the communications port causes the rotatable gobo to rotate in a second state and a second state operational code is stored in the memory;

wherein the first state operational code causes the rotatable gobo to rotate in a substantially smooth manner about a three hundred sixty degree rotation;

wherein the second state operational code causes the rotatable gobo to rotate in an incremental manner about a 360 degree rotation;

wherein the first state operational code and the second state operational code are different operational codes;

and wherein in response to the second command, the rotatable gobo:

rotates from the first rotational position to the second rotational position continuously;

stops rotating for a dwell time after reaching the second rotational position;

rotates from the second rotational position to the third rotational position continuously;

and stops rotating for the dwell time after reaching the third rotational position;

wherein the difference between the first rotational position and the second rotational position is an increment, and the difference between the second rotational position and the third rotational position is the increment;

and wherein the second command includes the dwell time and the increment.

10. The multiparameter lighting apparatus of claim 9 wherein the first command causes the first rotatable gobo to rotate three hundred sixty degrees in a first amount of time;

wherein the second command causes the first rotatable gobo to rotate three hundred sixty degrees in a second amount of time;

and wherein the first amount of time and the second amount of time are substantially the same.

11. The multiparameter lighting apparatus of claim 9 wherein the first command and the second command are compliant with the DMX protocol.

12. A method for operating a multiparameter lighting apparatus, wherein the multiparameter lighting apparatus includes a base housing, a yoke, a lamp housing, a projection lens, and a plurality of rotatable gobos, the lamp housing remotely positionable in relation to the base housing by a motor, and wherein the method comprises causing the multiparameter lighting apparatus to produce a light path;

selecting a first rotatable gobo of the plurality of rotatable gobos to be in a light path for projection on a projection surface by the projection lens;

receiving a first command at a communications port of the multiparameter lighting apparatus and in response to the first command, causing the first rotatable gobo to rotate in a first state such that the first rotatable gobo rotates in a substantially smooth manner about a three hundred sixty degree rotation, such that in response to the first command, the first rotatable gobo rotates continuously from a first rotational position through a second rotational position to a third rotational position; and receiving a second command at the communications port and in response to the second command causing the first rotatable gobo to rotate in a second state such that the first rotatable gobo rotates in an incremental manner about a three hundred sixty degree rotation, such that in response to the second command, the first rotatable gobo:

rotates from the first rotational position to the second rotational position continuously;

stops rotating for a dwell time after reaching the second rotational position;

rotates from the second rotational position to the third rotational position continuously;

and stops rotating for the dwell time after reaching the third rotational position;

wherein the difference between the first rotational position and the second rotational position is an increment, and the difference between the second rotational position and the third rotational position is the increment;

and wherein the second command includes the dwell time and the increment.

13. The method of claim 12 wherein the multiparameter lighting apparatus includes a memory, and the method further comprises storing the dwell time in the memory.

14. The method of claim 12 wherein the first command and the second command are compliant with the DMX protocol.

15. A method for operating a multiparameter lighting apparatus, wherein the multiparameter lighting apparatus includes a base housing, a yoke, a lamp housing, a projection lens, and a plurality of rotatable gobos, the lamp housing remotely positionable in relation to the base housing by a motor, and wherein the method comprises receiving a first command at a communications port of the multiparameter lighting apparatus and in response to the first command causing a first rotatable gobo of the plurality of rotatable gobos to rotate in a substantially smooth manner about a three hundred sixty degree rotation while in the light path, such that in response to the first command, the first rotatable gobo rotates continuously from a first rotational position through a second rotational position to a third rotational position; and receiving a second command at the communications port and in response to the second command causing the first rotatable gobo to rotate in an incremental manner about a three hundred sixty degree rotation, such that in response to the second command, the first rotatable gobo:

rotates from the first rotational position to the second rotational position continuously;

stops rotating for a dwell time after reaching the second rotational position;

rotates from the second rotational position to the third rotational position continuously;

and stops rotating for the dwell time after reaching the third rotational position;

wherein the difference between the first rotational position and the second rotational position is an increment, and the difference between the second rotational position and the third rotational position is the increment;

and wherein the second command includes the dwell time and the increment.

16. The method of claim 15 wherein the second command includes a rate of increments that the first rotatable gobo rotates; and further comprising storing in a memory of the multiparameter lighting apparatus the rate of increments that the first rotatable gobo rotates.

17. The method of claim 16 wherein the method further includes storing the dwell time in the memory.

18. The method of claim 14 further comprising causing animation effects in response to the incremental manner the first rotatable gobo is rotated when a gobo likeness is projected by the multiparameter lighting apparatus.

19. The method of claim 14 wherein the first and second commands are compliant with the DMX protocol.

* * * * *